169-43 SR
1/8/85 XR 4,492,514

United States Patent [19]
Dron

[11] Patent Number: 4,492,514
[45] Date of Patent: Jan. 8, 1985

[54] SUBMERGED PUMP ASSEMBLY AND METHOD OF MAKING AND USING SAME

[75] Inventor: James B. Dron, Orange, Calif.

[73] Assignee: Stang Hydronics Inc., Orange, Calif.

[21] Appl. No.: 178,844

[22] Filed: Aug. 18, 1980

[51] Int. Cl.³ ..... F04D 7/00
[52] U.S. Cl. ..... 415/1; 415/116; 169/43
[58] Field of Search ..... 415/1, 53, 116, 117, 415/201; 422/7, 9; 169/5, 13, 43, 46

[56] References Cited

U.S. PATENT DOCUMENTS 3,130,878 4/1964 Zimmermann ..... 415/53
3,771,604 11/1973 Norman et al. ..... 169/43

FOREIGN PATENT DOCUMENTS 2803367 8/1978 Fed. Rep. of Germany ..... 415/116
39172 11/1971 Japan ..... 415/1
64162 5/1980 Japan ..... 415/1

*Primary Examiner*—Robert W. Jenkins
*Assistant Examiner*—Christine A. Peterson
*Attorney, Agent, or Firm*—Gausewitz, Carr, Rothenberg & Edwards

[57] ABSTRACT

A method and means for providing a protective environment for submerged pumps are described. For a submerged water pump a shell or casing is installed to enclose at least a lower portion of the pump, and a protective fluid medium, typically compressed air, is introduced in the shell to exclude water from contacting the pump operating components or lines when the pump is not in use. Means are provided for quickly removing the protective medium and permitting water to enter the pump when it is desired to put the pump into operation.

29 Claims, 2 Drawing Figures 80
106
82
62
84
112
114
116
118
D
64
134
132
130
A
146
137
136
86
140
110
102
104
66
70
98
96
94
92
90
88
100
B
C
68
130
102

SUBMERGED PUMP ASSEMBLY AND METHOD OF MAKING AND USING SAME

BACKGROUND OF THE INVENTION

Vertically oriented pumps that pump liquid from a lower level to a higher level are well known. Both positive displacement and centrifugal or turbine-type pumps have been successfully used for such purposes for many years. Often such pumps may be used only intermittently, and they may need protection from their liquid environment when not in use to avoid encountering undesirable corrosion or wear or, in some cases, to prevent them from being rendered inoperable due to deposits or other effects of the environment during the inactive periods.

Typical of the pumps that need protection when not in use are those employed as emergency pumps for fire extinguishing apparatus on coastal facilities or offshore platforms. In a typical platform used for offshore oil drilling operations, a fire extinguisher pump may not be needed for months (or even years), and, thus, it may remain idle during a long period of time. However, when a fire breaks out on such a platform, it constitutes one of the most hazardous and time-critical emergency situations that may be encountered. To avoid disastrous consequences, it is necessary to quickly provide a means for delivering very large quantities of sea water at high pressures sufficient to reach all elevations and spaces on the platform.

Since platforms may extend fifty to a hundred feet (or even higher) above the ocean surface, the need for reliable, high pressure, high volume water pumping systems is apparent. Unfortunately, if the pump and associated gear have been idle in the water for a substantial period of time, there is a grave risk that their water delivery capability may have been severely impaired or even destoryed in the interim. This may result from a number of factors, including corrosion, deposits of foreign matter or clogging or fouling with seaweed or other plant life. A very common problem has also been the fouling of pumps by growths or layers of animal life (especially mollusks), such as mussels and similar shellfish, which attach themselves tenaciously to exposed inlets and interiors as well as to exterior portions of pumps and lines that are left submerged in the water.

Whatever the cause, even heavy-duty pump systems may be found to have been rendered totally inoperable at the critical time they are needed to fight a fire due, for example, to the pump impellers becoming immovably fouled or locked.

It has been contemplated to alleviate the risk of loss of pumping capacity by several methods. For example, the pump may be mounted well above the high water line on the platform, and a suction line or tube can be extended from the pump down into the water. However, while this will protect the pump itslef, it is unsatisfactory for most uses because it risks becoming inoperable at critical times due, e.g., to a loss of vacuum in the suction line, the necessity for priming the pump, the need for a strainer at the foot of the suction line, and the like. Moreover, this technique still risks the fouling or clogging of the suction line, and it cannot function at all in areas where tide differentials exceed about thirty feet.

It has also been contemplated to position the pump below water level, but to mount it on a pivoting frame so that it can be pivoted up out of the water when it is not in use. This, however, presents other problems and risks due to the potential failure of swivel joints, supporting means, and drive mechanisms, as well as the risk of undue delay in getting the pump positioned in the water during the critical early moments after the outbreak of a fire.

There has thus been a long felt need for a submerged pump assembly, and a method for adapting submerged pumps to overcome (or at least greatly alleviate) these and other problems of the prior art. It is an object of the present invention to achieve this result.

SUMMARY OF THE INVENTION

This invention contemplates a method and means for providing a protective environment for pumps that are submerged for substantial periods of time in a liquid medium such as water. In accordance with the invention, a shell or casing is installed to enclose at least a lower portion of the pump around the pump inlet, and a protective fluid medium, such as compressed air, or other gas, is introduced into the shell. The compressed air excludes and displaces water from the interior of the pump and the shell downwardly and thus prevents it from contacting the pump operating components (and lines) when the pump is not in use. When it is desired to activate the pump, the air is bled off from both the pump and the interior of the shell, thus allowing the water to rise inside the components to a level corresponding to the level of the body of water in which the pump is submerged. This displaces the air from the interior of the pump and thus achieves a priming effect so that the pump is immediately ready for activation. After the use of the pump is terminated, compressed air is again introduced into the shell, thus displacing the water level downwardly out of contact with the pump; and any water inside the pump simultaneously drains downwardly, thus leaving the pump in a substantially dry condition while it is idle. By keeping the pump out of contact with the body of water, corrosion is greatly reduced and plant and animal life are prevented from fouling the interior or exterior of the pump.

and

Figure 2:
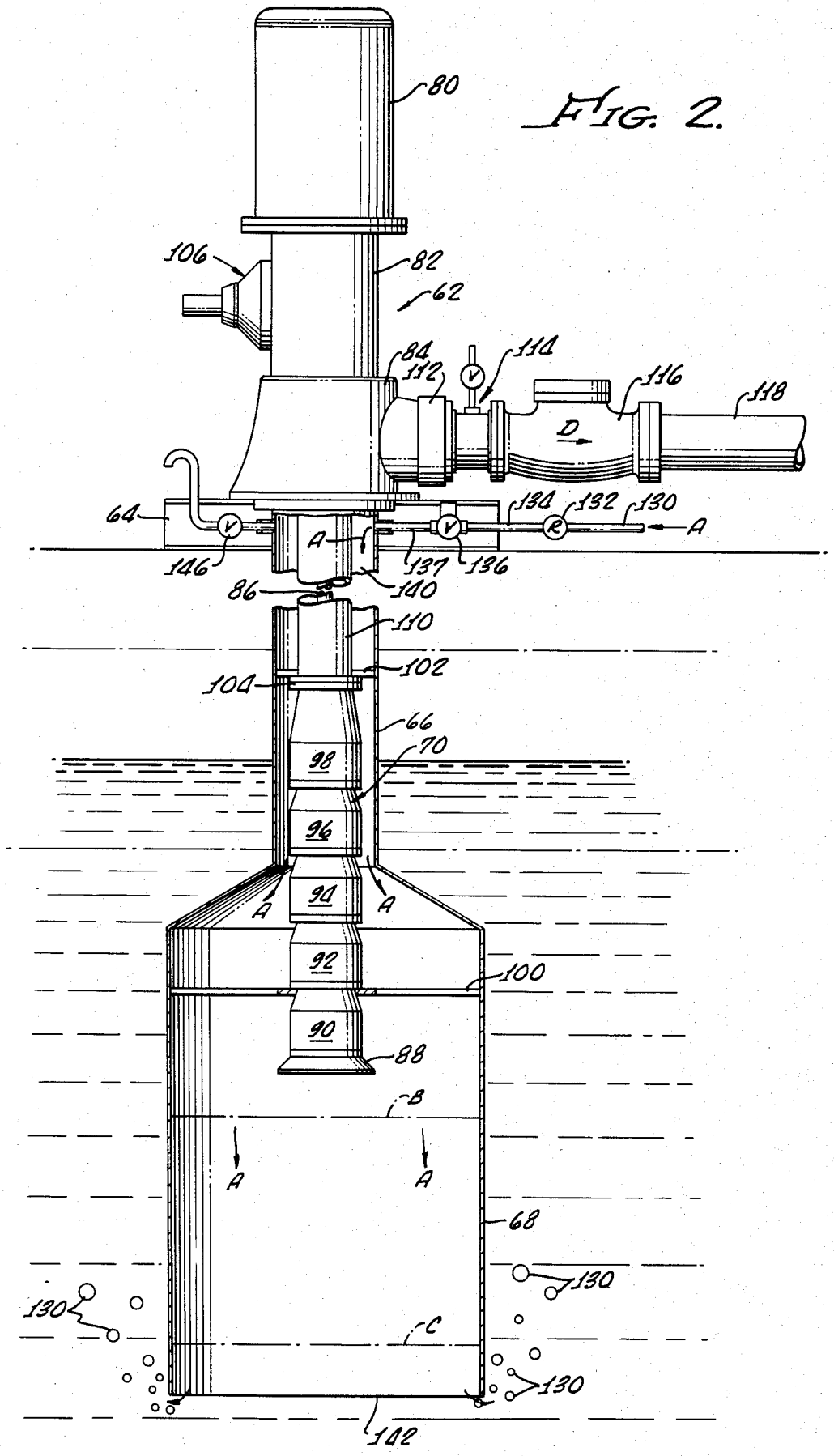

FIG. 2 is a fragmentary cross-section of the pump assembly and related facilities.

DETAILED DESCRIPTION OF THE INVENTION

Figure 1:
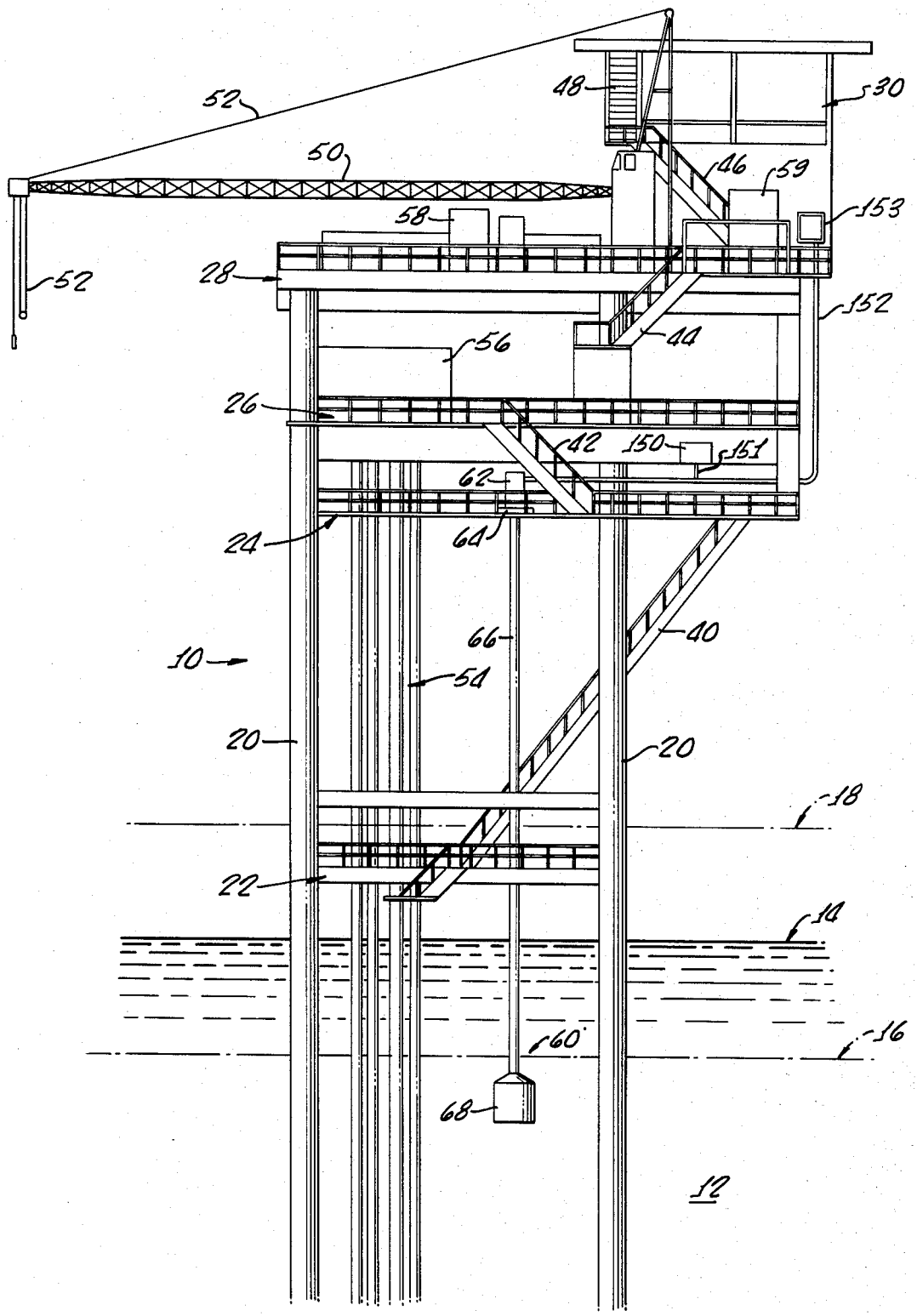
FIG. 1 shows a typical offshore platform including a pump assembly constructed in accordance with the invention.

As shown in FIG. 1, an offshore platform 10 is constructed partially submerged in a body of water 12 having a mean surface level 14, a low tide level 16, and a high tide level 18. The platform 10 includes vertical columns or piles 20, a lower landing 22, intermediate landings 24 and 26, and an upper landing 28. Depicted at 30 is storage space, offices or quarters.

The various landings are interconnected for passage by ladders or stairways 40, 42, 44, 46 and 48. A boom 50 with associated lines 52 and various pipes and casing 54 for crude oil pumping are also depicted schematically in FIG. 1, together with miscellaneous equipment 56, 58 and 59.

A water pump assembly 60 for pumping sea water in accordance with the present invention is shown including a discharge head and pump motor assembly 62. A mounting frame 64 for mounting the motor to landing 24 is also illustrated schematically.

Extending downwardly from the landing 24 and the discharge head and pump motor assembly 62 is a water pump outer shell or casing 66 which connects with a skirt 68 underneath the surface of the body of water 12.

FIG. 1 also shows schematically an auxiliary pump 150 and associated downstream lines 151 and 152, and fire fighting equipment 153 for use in combination with the submerged pump assembly of this invention, as described hereinafter.

FIG. 2 depicts the discharge head and pump motor assembly 62 mounted on mounting frame 64 and also shows a five stage deep well turbine pump assembly 70 enclosed within water pump outer shell or casing 66 and skirt 68. The head and pump motor assembly 62 is depicted as including a motor 80, which may be of any appropriate type, including gas turbine, electric, diesel, gasoline operated, or the like. The motor 80 is connected via drive means 82 through the pump discharge head 84 and drive shaft 86, which drives the five stage turbine pump assembly 70. The turbine pump assembly 70 includes a suction bell 88 at the lower end of the first stage 90 of the five stage pump. Above first stage 90 are the second, third, fourth, and fifth stages 92, 94, 96 and 98, respectively, the stages being connected in series to each other. Also shown in FIG. 2 is a lower mounting frame or spider 100 connecting the skirt 68 to the first stage 90 and an upper mounting frame or spider 102 and flange means 104 connecting the top of pump assembly 70 to the outer shell or casing 66.

To operate the pump assembly (for example, in the event of a fire), power is delivered to the pump by means of motor 80 through drive means 82 or, alternatively, through a secondary or emergency power source (not shown) operating through angle gear drive means 106.

The offshore water level, whether it is at the mean water line 14, low tide 16, or high tide 18, is well above suction bell 88 of the first stage 90 of pump assembly 70. Thus, through hydrostatic force, the water enters the pump assembly and primes it and is then pumped upwardly through riser or pipe 110 to discharge head 84, from which it is distributed through outlet 112, check valve 116, and discharge line 118, to the various lines and the hoses used for the fire extinguishing operation (not shown).

After the use of the pump is completed, there may be a long period of idleness before it is needed again, and it is during this period that it is particularly important to displace the sea water from the interior of the pump and associated lines and gear. This is achieved by closing valves 114 and 146 and introducing a fluid, such as compressed air, nitrogen, or other suitable fluid, from a source (not shown) through supply line 130, regulator 132, line 134, gas inlet control valve 136, and line 137 into the interior of pressure chamber 140 inside the outer shell or casing 66. The compressed air or other fluid is supplied at a sufficient pressure to displace the sea water from the interior of casing 66 downwardly to the open bottom or outlet 142 of skirt 68, as shown by the various arrows A. When the water level is lowered below suction bell 88, the sea water remaining in pump assembly 70 and riser 110 also drains downwardly leaving it in a substantially dry condition for its protection when it is not in use.

An important feature of the present invention is in the provision of skirt 68 in a size at least about twice the diameter of suction bell 88, typically at least three times the diameter, and preferably ranging from about three to about six times the diamter of the bell 88. The precise dimensions may vary, depending upon the delivery capacity and characteristics of the pump and the particular type of liquid to be pumped. By way of example, it is contemplated to use a skirt about 50 to 60 inches in diameter for a conventional pump having a suction bell about 18 inches in diameter. The optimum skirt size may be determined by minimal experimentation; however, if it is made too small in diameter relative to the diameter of the suction bell, cavitation and loss of pumping capability will result.

It is also important to extend the skirt 68 below the bottom of the suction bell 88 for a distance sufficient to prevent any substantial contact of sea water, sea growth, or animal life, or other undesirable constituents of the water, with the interior of the pump. Generally, for typical offshore platform operations employing pumps as parts of emergency fire extinguishing facilities, the skirt should extend at least about 2 feet below the suction bell 88. Typically, it is contemplated that the skirt may extend downwardly from about 3 to 20 feet or from about 2 to about 10 times the suction bell diameter.

It is preferable to provide a means for maintaining the water level inside the skirt 68 well below suction bell 88, and this may be achieved by various techniques. For example, a level control means (not shown) may be employed to automatically control gas valve 136 to introduce additional compressed air continuously to displace the water level down to the bottom opening 142 of the skirt, with excess air 130 passing out of the opening into the sea water. Alternatively, the control means may provide for maintenance of water levels within a range inside the skirt intermediate the opening 142 and the suction bell 88.

It is also contemplated to supply the compressed gas at a constant pressure and to allow the water level inside skirt 68 to rise and fall according to the water line outside the skirt. Thus, when the water is at high tide 18, the water level inside the skirt may be maintained at, for example, level B, whereas when the external water level is at low tide 16, the level inside the skirt may be maintained at level C. In order to operate in this fashion, it is necessary to have a skirt length at least in excess of the maximum differential between high and low tide; however, this mode of operation permits minimal use of compressed gas, since it does not require any constant flow of gas out the bottom opening 142.

After a period of idleness when it is desired to again activate the pump, one merely closes gas valve 136 and opens the vent 146 to bleed the compressed gas out of the pressure chamber 150 to allow the liquid level to rise to a level corresponding to the water level outside the pump assembly. Valve 114 is also opened to permit air inside the pump mechanism and lines to be displaced upwardly out of the pump. It is to be understood that valve 146 is left open throughout the pumping operation, but valve 114 is closed after the air is removed.

It is also contemplated to employ the pump assembly and means described above in tandem with an auxiliary or jockey pump 140 positioned (as shown in FIG. 1) downstream of valve 116. Typically, valve 116 comprises a one-way or check valve to permit water to flow only in the direction indicated by arrow D. This type of valve is desirable when the pump assembly is used in combination with a secondary or auxiliary pump downstream in order to permit the downstream lines to remain filled with water under pressure while the main pump assembly 70 is filled with air. The downstream pump 150 may be of very small capacity (relative to the five stage pump assembly 70), since its only function is to keep the downstream apparatus under pressure filled with water, when the system is idle. Thus, it may include control means responsive to the downstream line pressure to turn the pump on and off.

When a fire occurs and an operator uses the fire extinguisher system, the small pump 150 will not, of course, be capable of sustaining the system pressure at sufficient levels. Thus, it is preferred to also employ conventional pressure-responsive control means (not shown) to activate the main pump assembly 70 when the downstream pressure drops to a predetermined low level. Such control means may also be employed to close air valve 136 and open valves 114 and 146.

It is contemplated to use conventional metallic construction for casing 66 and skirt 68; however, it will be understood that other materials, such as plastics, may be suitable for certain uses. Also, while casing 66 has been depicted extending all the way up to platform 24, it may often be desirable to terminate it well below that level.

While the invention has been described principally in connection with its use on offshore platforms in sea water, it is to be understood that the invention will have utility where any liquid medium must be excluded from a pump during idle periods. Similarly, other fluids than compressed air, including liquids, may be useful in some circumstances to displace the undesired constituents downwardly out of the pump.

Many other uses and variations of the invention will be apparent to those skilled in the art, and while specific embodiments of this invention have been described, these are intended for illustrative purposes only. It is intended that the scope of the invention be limited only by the attached claims.

I claim:

1. In a pump assembly means for pumping a liquid from a body of said liquid wherein said means includes a rotary pump which has at least an inlet portion submerged in said body for substantial periods of time when the rotatable element in said pump is not rotating and wherein said liquid contains constituents having a tendency to impair the performance of said pump after extended contact therewith, the improvement comprising:

casing means at least partially submerged in said body of liquid and disposed about the periphery of at least said pump inlet portion and spaced apart therefrom, said casing means defining an opening at a portion thereof below said inlet portion of said pump, means for displacing said liquid downwardly to a level below the upper surface of said body of liquid and out of substantial contact with at least the interior of said submerged portion of said pump, means for maintaining said liquid out of substantial contact with said interior when the rotatable element in said pump is not rotating, and means for introducing said liquid into said interior of said pump up to the level of the upper surface of said body of liquid when pumping of said liquid is desired.

2. The invention as recited in claim 1 wherein said casing means comprises a substantialy rigid shell disposed generally about the periphery of at least the inlet portion of said pump, said shell extending below said inlet portion and being open at its lower end.

3. The invention as recited in claim 2 wherein the walls of said shell extend at least about 2 feet below said inlet portion.

4. The invention as recited in claim 3 wherein the walls of said shell extend at least about 3 to about 20 feet below said inlet portion.

5. The invention as recited in claim 2 wherein the walls of said shell extend about 2 to 10 pump inlet diameters below said inlet portion.

6. The invention as recited in claim 2 wherein said shell extends along the entire length of said pump.

7. The invention as recited in claim 2 wherein said shell has a length sufficient to cover at least all the parts of said pump assembly means which are below the level of the upper surface of said body of liquid when in use.

8. The invention as recited in claim 2 wherein said shell is spaced apart for said pump a distance sufficient to permit fluid flow therebetween.

9. The invention as recited in claim 8 wherein said shell comprises an upper portion having walls positioned at least above said inlet portion of said pump and a lower portion having walls connected to said upper portion and extending therefrom to at least below said inlet portion of said pump.

10. The invention as recited in claim 9 wherein said upper and lower portions are substantially cylindrical and spaced concentrically about said pump, said lower portion having a diameter at least about twice the diameter of said pump inlet portion.

11. The invention as recited in claim 10 wherein said lower portion has a diameter at least about three times the diameter of said pump inlet portion.

12. The invention as recited in claim 10 wherein said lower portion has a diameter in the range from about three to six times the diameter of said pump inlet portion.

13. In a pump assembly means for pumping a liquid from a body of said liquid wherein said means includes a rotary pump which has at least an inlet portion submerged in said body for substantial periods of time when the rotatable element in said pump is not rotating and wherein said liquid contains constituents having a tendency to impair the performance of said pump after extended contact therewith, the improvement comprising:

casing means at least partially submerged in said body of liquid and disposed about the periphery of at least said pump inlet portion and spaced apart therefrom, said casing means defining an opening at a portion thereof below said inlet portion of said pump, displacement means for introducing compressed gas into the interior of said pump and into the space between said casing means and said pump for substantially displacing said liquid downwardly therefrom to a level below the upper surface of said body of liquid, means for maintaining said liquid out of substantial contact with said interior when the rotatable element in said pump is not rotating, and means for introducing said liquid into said interior of said pump when pumping of said liquid is desired.

14. The invention as recited in claim 13 wherein said liquid comprises water and said displacement means comprises means for introducing compressed air into said pump and said space in amounts sufficient to displace said water downwardly out of said opening.

15. The invention as recited in claim 14 wherein said means for maintaining said liquid out of substantial contact with said interior comprises means for introducing additional amounts of air over a period of time when said pump is idle.

16. The invention as recited in claim 15 wherein said means for maintaining said liquid out of substantial contact with said interior comprises means for introducing said additional amounts of air intermittently to maintain substantially constant pressure inside said casing.

17. The invention as recited in claim 15 wherein said means for maintaining said liquid out of substantial contact with said interior comprises means for introducing said additional amounts of air to maintain a substantially constant water level within said casing below said pump and below the level of the upper surface of said body of liquid.

18. The invention as recited in claim 13 wherein said means for maintaining said liquid out of substantial contact with said interior comprises means for introducing said additional amounts of air substantially continuously while said pump is idle.

19. In a pump assembly means for pumping a liquid from a body of said liquid wherein said means includes a rotary pump which has at least an inlet portion submerged in said body for substantial periods of time when the rotatable element in said pump is not rotating and wherein said liquid contains constituents having a tendency to impair the performance of said pump after extended contact therewith, the improvement comprising:

casing means comprising a substantially rigid shell spaced apart from the periphery of at least the inlet portion of said pump, said shell extending below said inlet portion and being open at its lower end, displacement means comprising means for introducing compressed air into said pump and said space between said pump and said shell in amounts sufficient to displace said liquid downwardly out of said opning to a level below the upper surface of said body of liquid, means for maintaining said liquid out of substantial contact with the interior of said pump comprising means for introducing additional amounts of air over a period of time when the rotatable element in said pump is not rotating, means for permitting said liquid to rise into said interior of said pump to the level of said upper surface when pumping of said liquid is desired, and vent means above said pump and casing in communication therewith for venting said air from the interior of said pump and said casing for permitting liquid to enter in an amount sufficient to prime said pump and permit pumping thereof.

20. An improved pump assembly comprising:

a rotary pump having an upper end, a lower end and a midportion therebetween and a rotary element in said pump, a tubular casing spaced from and disposed about said pump, said casing extending upwardly beyond said upper end and downwardly below said lower end, said casing being closed at its upper end and open at its lower end, means for introducing compressed air into the space between said pump and said casing and into the interior of said pump when said rotary element is not rotating, and valve means for bleeding said air from said upper end of said casing and from said upper end of said pump.

21. In a method for operating and maintaining a water pump assembly of the type wherein a rotary pump is at least partially submerged in a body of water and which is operated at intervals to pump a quantity of said water through an outlet above said body of water and the rotatable element in said pump is not rotating for substantial periods of time between such intervals, the improvement comprising:

enclosing at least a lower portion of said pump including the water inlet thereof in a casing which is spaced apart from said pump and which extends below said inlet, excluding the entry of water into said casing through all portions thereof above said water inlet, permitting entry of water into said casing at a level below said inlet and permitting said water to rise to a level at least sufficient to enter said inlet for pumping by said pump, operating said pump to pump water out of said outlet above said body of water, terminating the operating of said pump, introducing a gas into said casing at a pressure at least sufficient to displace the water therein downwardly to a level below said inlet of said pump, draining water from the interior of said pump and replacing said water with said gas, whereby said interior is rendered substantially water free, maintaining said gas in said pump and casing and excluding water therefrom during said periods of time when the rotatable element in said pump is not rotating, and bleeding said gas from said pump and casing and displacing said gas with water entering said casing at a level below said inlet when it is desired to activate said pump.

22. The invention as recited in claim 21 wherein said method further comprises enclosing all of said pump which is submerged below the surface of said body of water in said casing, and wherein said method further comprises extending said casing to a level at least about two pump inlet diameters below the inlet of said pump.

23. The invention as recited in claim 22 wherein when said pump is in use said water is caused to rise in said casing to a level corresponding to the surface of said body of water.

24. The invention as recited in claim 21 further comprising the steps of detecting water pressure in said assembly downstream of said pump outlet, and activating said bleeding of said gas and operating said pump when said downstream pressure reahces a predetermined low level.

25. The invention as recited in claim 21 wherein said bleeding of said gas from said pump and casing is terminated after sufficient water has entered said pump to prime it for pumping.

26. The invention as recited in claim 25 wherein said method comprises bleeding the gas from said pump through an outlet separate from the outlet for gas bled from said casing.

27. A method of fighting fires on an offshore oil-drilling platform, said method comprising:

(a) mounting a rotary pump at an offshore oil-drilling platform and at such elevation that at least the inlet of said pump is below sea level at all tide conditions, (b) mounting a casing, having a sea-water opening the elevation of which is below said pump inlet, at said pump in such relationship as to:

(1) prevent sea water from reaching at least said pump inlet when said casing contains fluid other than sea water, (2) not interfere with cavitation-free operation of said pump when said casing contains sea water, and (3) prevent accumulation of mollusks at said pump inlet or sufficiently near thereto to impede flow of water from the sea into said pump, (c) injecting fluid, other than sea water, into said casing to thus expel sea water from said casing out said sea-water opening when the pump is not rotating, (d) maintaining said pump in nonrotating condition at substantially all times, except when a fire occurs, and (e) driving said pump to pump water from the sea to the fire as soon as a fire occurs on the platform.

28. The invention as claimed in claim 27, in which said method further comprises employing a gas as said fluid, continuing said injection until sea water is forced out of said casing through said sea-water opening to thus cause at least said pump inlet to be surrounded by said gas and not water, and venting gas from said casing, and thus permitting inflow of sea water to at least the level of said pump inlet, when it is desired to perform said step (e).

29. The invention as claimed in claim 28, in which said casing is caused to surround said entire pump, and in which said method further comprises venting gas from said casing and said pump through separate outlets.

* * * * *